US009722312B2

(12) United States Patent
Lilja

(10) Patent No.: US 9,722,312 B2
(45) Date of Patent: Aug. 1, 2017

(54) LOOP ANTENNA WITH A MAGNETICALLY COUPLED ELEMENT

(71) Applicant: MICROSOFT TECHNOLOGY LICENSING, LLC, Redmond, WA (US)

(72) Inventor: Juha Lilja, Tampere (FI)

(73) Assignee: Microsoft Technology Licensing, LLC, Redmond, WA (US)

( * ) Notice: Subject to any disclaimer, the term of this patent is extended or adjusted under 35 U.S.C. 154(b) by 218 days.

(21) Appl. No.: 14/516,431

(22) Filed: Oct. 16, 2014

(65) Prior Publication Data

US 2016/0111786 A1 Apr. 21, 2016

(51) Int. Cl.

| | |
|---|---|
| ***H01Q 7/06*** | (2006.01) |
| ***H01Q 1/24*** | (2006.01) |
| ***H01Q 7/00*** | (2006.01) |
| ***H01Q 11/08*** | (2006.01) |
| ***H01Q 21/28*** | (2006.01) |

(52) U.S. Cl.

CPC ..... *H01Q 7/06* (2013.01); *H01Q 1/243* (2013.01); *H01Q 7/00* (2013.01); *H01Q 11/08* (2013.01); *H01Q 21/28* (2013.01)

(58) Field of Classification Search

CPC H01Q 7/00; H01Q 1/243; H01Q 7/06; H01Q 21/28; H01Q 11/08

See application file for complete search history.

(56) References Cited

U.S. PATENT DOCUMENTS

| | | | | |
|---|---|---|---|---|
| 6,137,447 | A * | 10/2000 | Saitoh | G06K 7/10336 343/742 |
| 7,495,621 | B2 | 2/2009 | Li et al. | |
| 8,344,959 | B2 | 1/2013 | Autti et al. | |
| 8,471,768 | B2 | 6/2013 | Wang et al. | |
| 8,478,372 | B2 | 7/2013 | Wehrmann et al. | |
| 8,525,734 | B2 | 9/2013 | Krogerus | |
| 2005/0088342 | A1* | 4/2005 | Parsche | H01Q 1/38 343/700 MS |
| 2006/0038730 | A1* | 2/2006 | Parsche | H01Q 7/04 343/741 |
| 2006/0044195 | A1* | 3/2006 | Arkko | H01Q 1/243 343/702 |
| 2007/0182658 | A1* | 8/2007 | Ozden | H01Q 1/243 343/866 |
| 2011/0006959 | A1* | 1/2011 | Menko | H01Q 1/2225 343/728 |
| 2011/0014958 | A1 | 1/2011 | Black et al. | |
| 2011/0063184 | A1* | 3/2011 | Furumura | G06K 19/07749 343/856 |
| 2011/0136444 | A1 | 6/2011 | Rhodes et al. | |

(Continued)

OTHER PUBLICATIONS

"International Search Report and Written Opinion Issued in PCT Application No. PCT/US2015/055191", Mailed Date: Dec. 21, 2015, 10 Pages.

(Continued)

*Primary Examiner* — Trinh Dinh

(57) ABSTRACT

A loop antenna with a magnetically coupled element is described. In an embodiment, the loop antenna comprises a loop element that has a feed contact and a ground contact. The loop antenna further comprises an open ended conductor that is magnetically coupled around the ground contact.

20 Claims, 7 Drawing Sheets

(56) References Cited

U.S. PATENT DOCUMENTS

| | | | | |
|---|---|---|---|---|
| 2011/0205134 | A1* | 8/2011 | Blumberg, Jr. | A47J 31/40 343/753 |
| 2012/0239294 | A1 | 9/2012 | Stahlin et al. | |
| 2013/0002501 | A1 | 1/2013 | Li et al. | |
| 2013/0196673 | A1 | 8/2013 | Smadi et al. | |
| 2014/0139380 | A1 | 5/2014 | Ouyang et al. | |
| 2014/0292611 | A1* | 10/2014 | Kubo | G06K 7/10336 343/867 |
| 2016/0064821 | A1* | 3/2016 | Nakano | G06K 7/10009 343/788 |
| 2016/0148752 | A1* | 5/2016 | Moon | H04B 5/0087 343/867 |

OTHER PUBLICATIONS

Rowson, Sebastian, "Optimizing Performance When Integrating Multiple Antennas", In IEEE Journal, vol. 16, Issue 8, Oct. 2000, 3 pages.

* cited by examiner

LOOP ANTENNA WITH A MAGNETICALLY COUPLED ELEMENT

BACKGROUND

Loop antennas, for example single folded loop antennas, are often used in mobile apparatuses, for example in mobile handsets. Typically, such a loop antenna may comprise one or two resonances to cover cellular bands. In addition, a mobile apparatus may comprise another antenna to cover complementary wireless system (CWS) bands.

SUMMARY

This Summary is provided to introduce a selection of concepts in a simplified form that are further described below in the Detailed Description. This summary is not intended to identify key features or essential features of the claimed subject matter, nor is it intended to be used to limit the scope of the claimed subject matter.

A loop antenna comprises a loop element that has a feed contact and a ground contact. The loop antenna further comprises an open ended conductor that is magnetically coupled around the ground contact.

Many of the attendant features will be more readily appreciated as the same becomes better understood by reference to the following detailed description considered in connection with the accompanying drawings.

DESCRIPTION OF THE DRAWINGS

The present description will be better understood from the following detailed description read in light of the accompanying drawings, wherein.

Like reference numerals are used to designate like parts in the accompanying drawings.

DETAILED DESCRIPTION

The detailed description provided below in connection with the appended drawings is intended as a description of the present examples and is not intended to represent the only forms in which the present example may be constructed or utilized. The description sets forth the functions of the example and the sequence of steps for constructing and operating the example. However, the same or equivalent functions and sequences may be accomplished by different examples.

Although the present examples may be described and illustrated herein as being implemented in a smartphone or a mobile phone, these are only examples of a mobile apparatus and not a limitation. As those skilled in the art will appreciate, the present examples are suitable for application in a variety of different types of mobile apparatuses, for example, in tablets etc.

Figure 1:
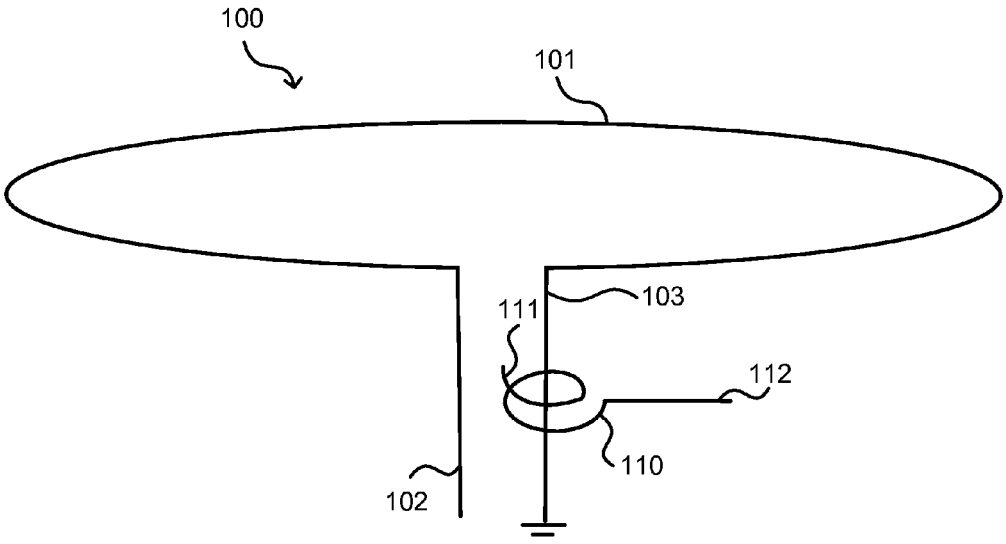
FIG. 1 is a diagram of a loop antenna.

FIG. 1 is a diagram of a loop antenna 100. The loop antenna 100 comprises a loop element 101 that has a feed contact 102 and a ground contact 103. The loop element 101 may comprise a folded loop element. However, it is to be understood that other loop elements may be used instead. The loop antenna 100 further comprises an open ended conductor 110 that is magnetically coupled around the ground contact 103. In other words, the magnetic coupling comprises having the open ended conductor 110 wrapped around the ground contact 103 while being physically isolated from the ground contact 103. Herein, the term "open-ended" refers to conductor 110 having an open end 111, i.e. an end that is not physically connected to anything. The other end of the conductor 110 may be physically connected to a transmission line 112. The length of the open ended conductor 110 may be substantially equal to a quarter of a wavelength at a frequency of operation.

The loop element 101 may be associated with a first radio system and the open ended conductor 110 may be associated with a second radio system. The first radio system may comprise a cellular radio system (e.g. global system for mobile communications (GSM) and/or wideband code division multiple access (WCDMA)), and the second radio system may comprise a complementary wireless system (CWS). The complementary wireless system may comprise at least one of a wireless local area network (WLAN), a global positioning system (GPS), and a bluetooth system. The transmission line may carry signals of the second radio system.

The open ended conductor 110 may act as a resonating element. At the same time, the diameter of the open ended conductor 110 wrapped around the ground contact 103 may be lower than a predetermined threshold so as to prevent the open ended conductor 110 from acting as a radiator.

Figure 2A:
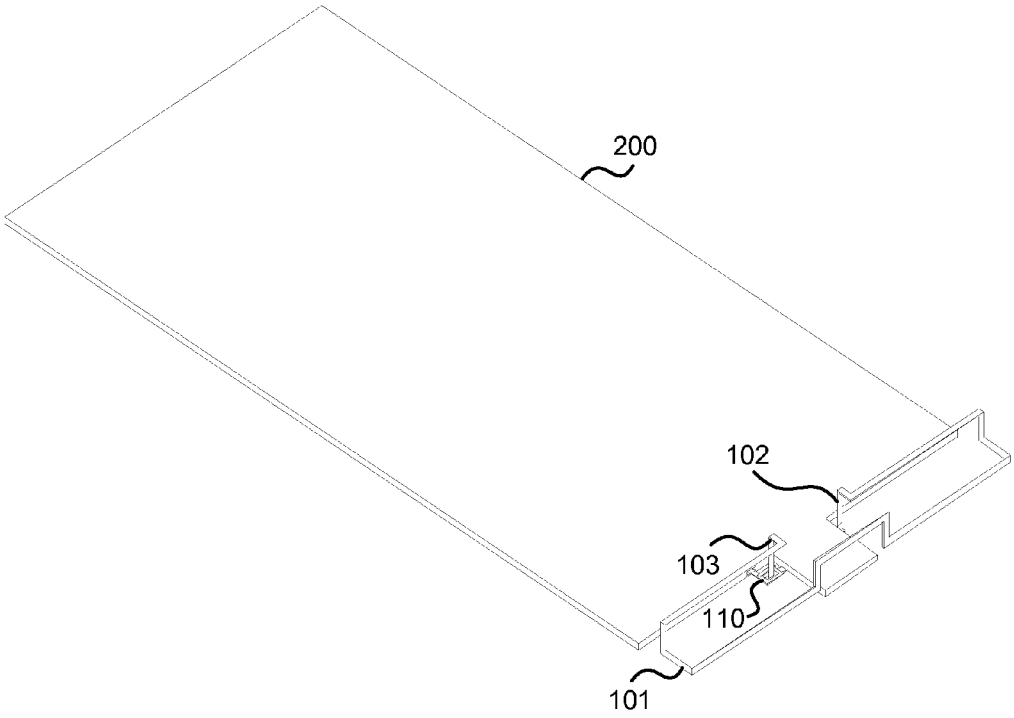
FIGS. 2*a*-2*c* are 3D views of a loop antenna.
Figure 2B:
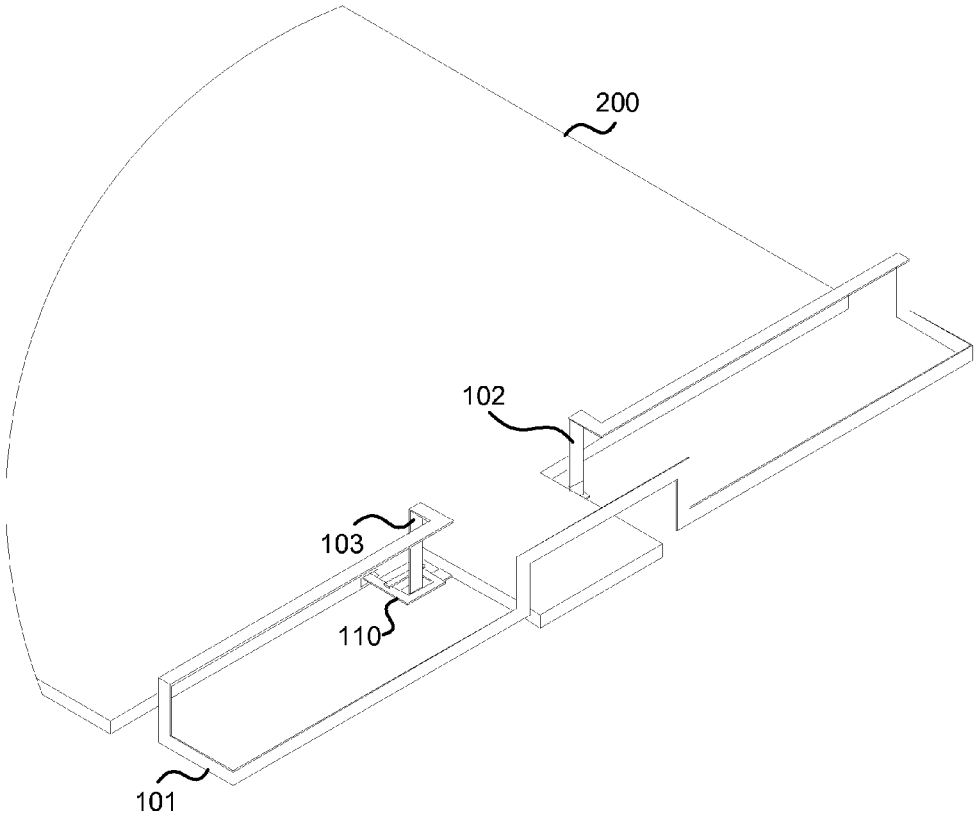
Figure 2C:
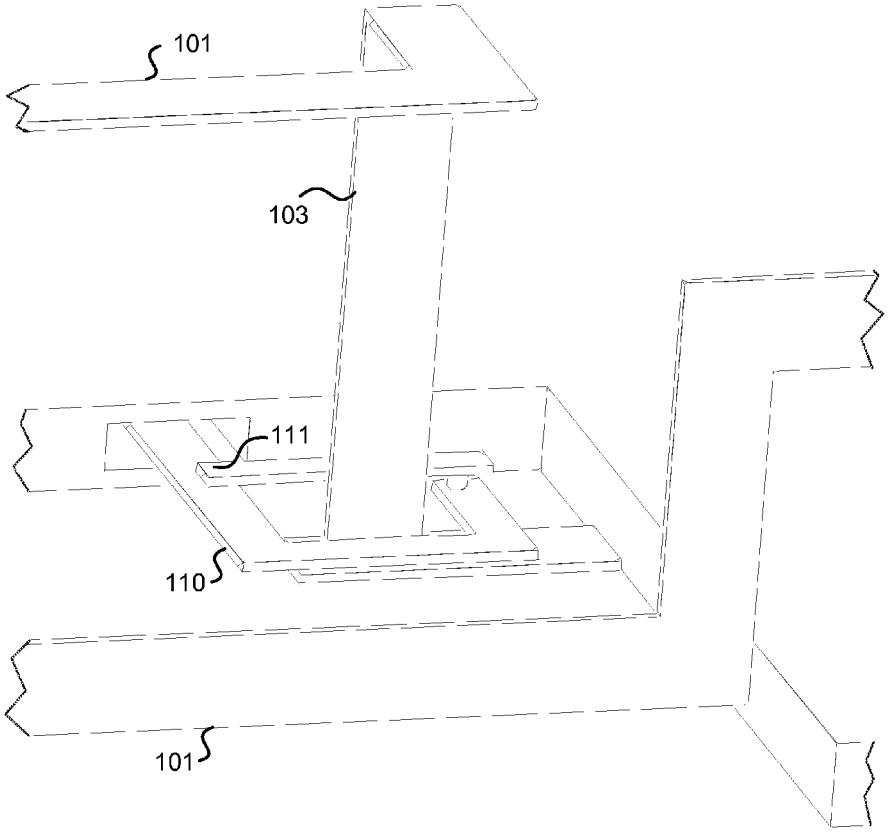

FIGS. 2*a*-2*c* are 3D views of an example of the loop antenna 100. In the embodiments of FIGS. 2*a*-2*c*, the loop antenna 100 is attached to a ground plate 200, i.e. to a conducting plate 200 that forms a ground plane. The ground plate 200 may be arranged for example inside a mobile apparatus, such as the mobile apparatus 300 of FIG. 3. The embodiment of FIG. 2*a* corresponds to that of FIG. 1 with like reference numerals used to designate like parts. FIG. 2*b* illustrates a close up of the embodiment of FIG. 2*a*. FIG. 2*c* illustrates a further close up of the embodiment of FIG. 2*b*.

In the embodiments of FIGS. 2*a*-2*c*, the open ended conductor 110 magnetically coupled around the ground contact 103 comprises a planar structure. The planar structure may be arranged or integrated into layers of a printed wiring board. The printed wiring board may be included in a mobile apparatus, such as the mobile apparatus 300 of FIG. 3. The loop antenna 100 may be arranged in a lower portion of the mobile apparatus 300. However, it is to be understood that other structures may be used instead of the planar one.

Figure 3:
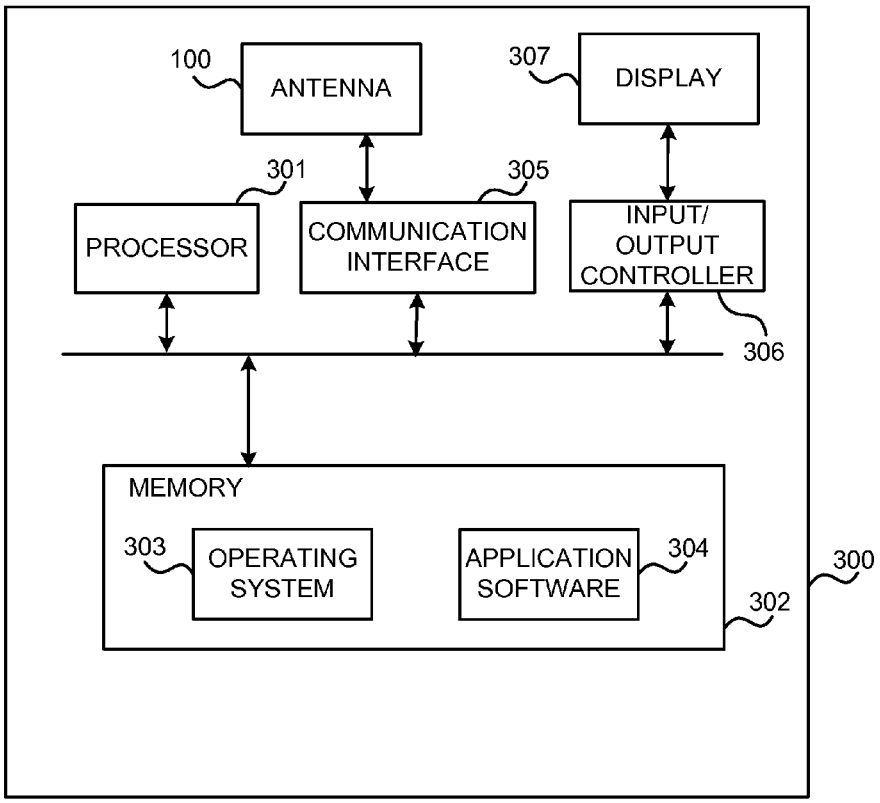
FIG. 3 is a block diagram of a mobile apparatus.

FIG. 3 illustrates various components of an exemplary mobile apparatus 300 which may be implemented as any form of a computing and/or electronic device.

The mobile apparatus 300 comprises one or more processors 301 which may be microprocessors, controllers or any other suitable type of processors for processing computer executable instructions to control the operation of the mobile apparatus 300. Platform software comprising an operating system 303 or any other suitable platform software may be provided at the mobile apparatus 300 to enable application software 304 to be executed on the device.

Computer executable instructions may be provided using any computer-readable media that is accessible by the mobile apparatus 300. Computer-readable media may include, for example, computer storage media such as memory 302 and communications media. Computer storage media, such as memory 302, includes volatile and non-volatile, removable and non-removable media implemented in any method or technology for storage of information such as computer readable instructions, data structures, program modules or other data. Computer storage media includes, but is not limited to, RAM, ROM, EPROM, EEPROM, flash memory or other memory technology, CD-ROM, digital versatile disks (DVD) or other optical storage, magnetic cassettes, magnetic tape, magnetic disk storage or other magnetic storage devices, or any other non-transmission medium that can be used to store information for access by a computing device. In contrast, communication media may embody computer readable instructions, data structures, program modules, or other data in a modulated data signal, such as a carrier wave, or other transport mechanism. As defined herein, computer storage media does not include communication media. Therefore, a computer storage medium should not be interpreted to be a propagating signal per se. Propagated signals may be present in a computer storage media, but propagated signals per se are not examples of computer storage media. Although the computer storage media (memory 302) is shown within the mobile apparatus 300 it will be appreciated that the storage may be distributed or located remotely and accessed via a network or other communication link (e.g. using communication interface 305).

The mobile apparatus 300 may comprise an input/output controller 306 arranged to output display information to a display device 307 which may be separate from or integral to the mobile apparatus 300. The input/output controller 306 may also be arranged to receive and process input from one or more devices, such as a user input device (e.g. a keyboard, camera, microphone or other sensor). In one example, the display device 307 may also act as the user input device if it is a touch sensitive display device. The input/output controller 306 may also output data to devices other than the display device, e.g. a locally connected printing device.

The input/output controller 306 may be in communication with one or more sensors such as one or more cameras, an inertial measurement unit and/or other sensors. This enables the mobile apparatus 300 to receive data observed by the sensors and to control the sensors.

The communication interface 305 may be used to receive a communication event via the antenna 100. The communication event may be, for example, an incoming call or an incoming message.

Figure 4:
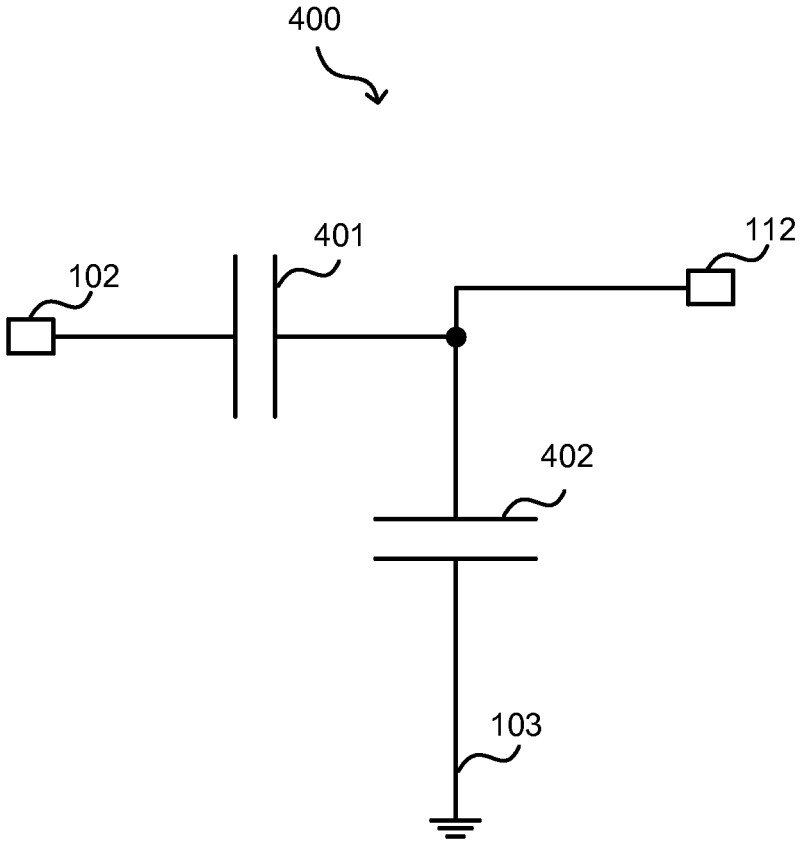
FIG. 4 illustrates an example of a matching circuit.

FIG. 4 illustrates an example of an L-type matching circuit 400. The matching circuit 400 may be used for adjusting a resonance frequency or impedance of the loop antenna 100 at the resonance frequency. The matching circuit 400 comprises a first capacitor 401 connected to the feed contact 102. The matching circuit 400 further comprises a second capacitor 402 connected to the ground contact 103. Furthermore, both the first capacitor 401 and the second capacitor 402 are connected to the transmission line 112. The capacitance of the first capacitor 401 may be e.g. 5.4 pF, and the capacitance of the second capacitor 402 may be e.g. 2.2 pF. However, it is to be understood that other capacitance values may be used instead. Furthermore, one capacitor may be used instead of two, and the implementation of the matching circuit is not limited to capacitors only. For example, inductors may also be utilized. Also, other matching circuit topologies may be used, such as PI-type matching.

Figure 5:
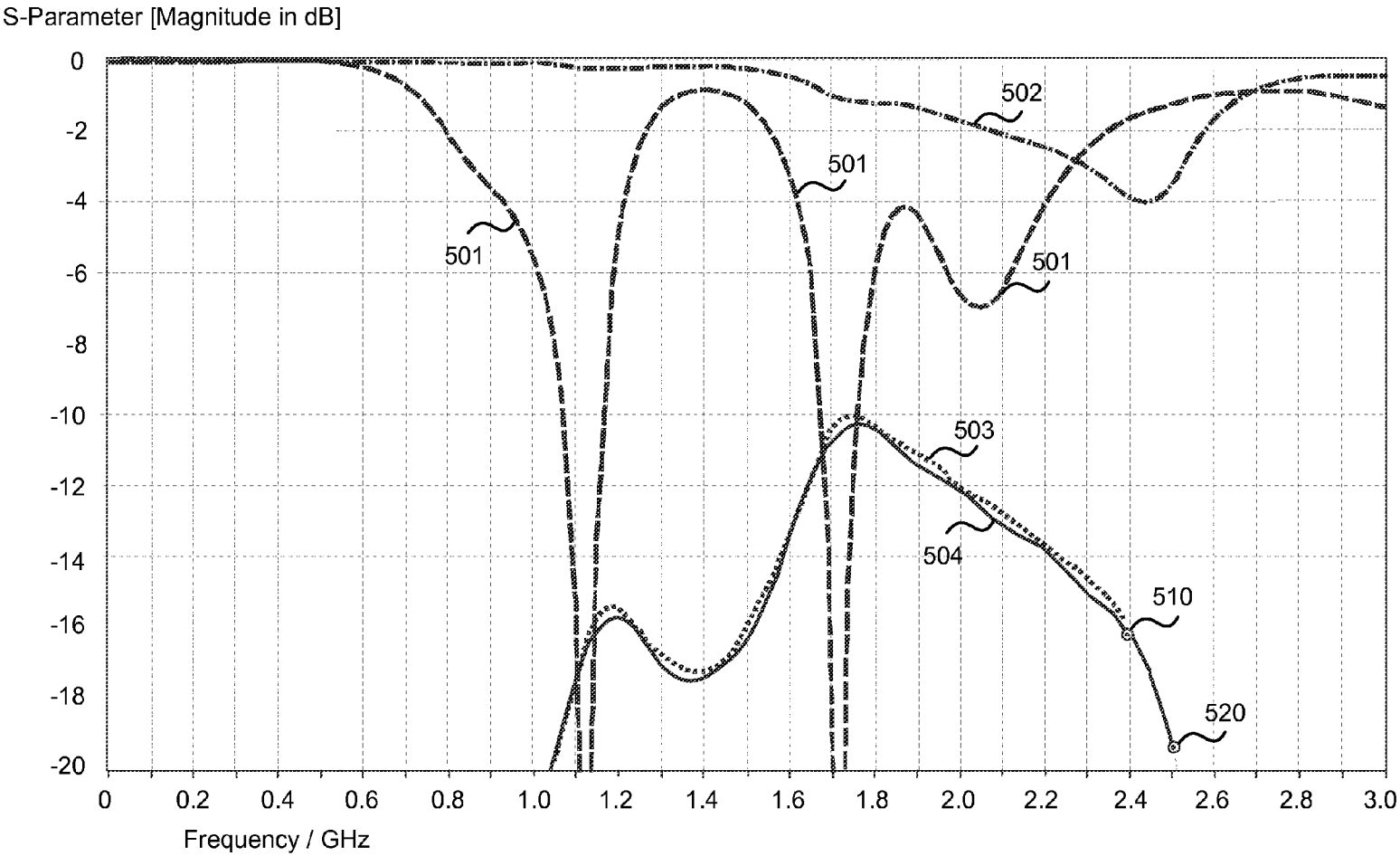
FIG. 5 illustrates antenna isolation between the first and the second radio systems.

FIG. 5 illustrates antenna isolation between the first and the second radio systems. The horizontal axis represents frequency in gigahertz, and the vertical axis represents scattering parameters (magnitude in decibels). Curve 501 represents the antenna return loss at the feed port or contact 102 of the loop element 101 which is associated with the first radio system. Here, the first radio system may operate around approximately 1 GHz (e.g. GSM 850/900 and WCDMA V and WCDMA VIII) and around approximately 2 GHz (e.g. GSM 1800/1900 and WCDMA I and WCDMA II).

Curve 502 illustrates the antenna return loss for the second radio system which here utilizes the open ended conductor 110 as its feed port. The return loss trace shows a notch at WLAN frequencies, i.e. when fed from that port, a signal at 2.45 GHz radiates from the antenna.

Curves 503 and 504 present antenna isolation, i.e., the curves illustrate how much power is coupled from the feed port or contact 102 to the open ended conductor 110 and vice versa, respectively. In the example of FIG. 5, points 510 and 520 illustrate that here the isolation is better than 15 dB at the operating frequencies of the second radio system. Sufficient isolation is needed when two different radio systems are using the same physical antenna structure.

At least some of the examples disclosed in FIGS. 1-5 are able to provide integration of e.g. a cellular antenna loop with e.g. a CWS antenna by using the same physical antenna for both radios, and using only two ports and one ground contact. The integration of the two radio systems is made by using an open ended magnetic coupling loop for the CWS antenna. This non-physical connection may provide good isolation (over 15 dB) between the two radio systems without having to use any additional filtering which may result in cost savings.

Furthermore, by using the same antenna for the two radio systems it makes it possible for all the antennas to be located at a same volume without disturbing each other, which may result in space savings. This may have benefits for industrial design.

In the case of metal covered mobile apparatuses, the top end of the mobile apparatus may be fully covered by metal because e.g. CWS antennas may be located at the bottom end of the mobile apparatus.

When the magnetic coupling is used to integrate a GPS antenna with a cellular antenna and the antennas are located at the bottom end of a mobile apparatus, the radiation pattern of the GPS antenna is steered towards the sky, which may be advantageous for the field performance—usually the radiation pattern of such antennas tend to be drawn by the mobile apparatus mechanics/ground plane. This may make it possible to improve GPS antenna radiation characteristics.

Furthermore, a contact spring for e.g. a CWS antenna may not be needed, because the coupling loop may be designed to the PWB layers. This may result in cost savings from having less need for contact springs. Furthermore, this may result in better reliability because of fewer breakable parts.

Furthermore, e.g. a WLAN antenna may be integrated to the bottom end of the mobile apparatus. This may result in reduced head loss because the antenna may not be located next to the user's ear.

An embodiment of a loop antenna comprises a loop element having a feed contact and a ground contact; and an open ended conductor magnetically coupled around the ground contact.

In an embodiment, the length of the open ended conductor is substantially equal to a quarter of a wavelength at a frequency of operation.

In an embodiment, the loop element is associated with a first radio system and the open ended conductor is associated with a second radio system.

In an embodiment, the first radio system comprises a cellular radio system.

In an embodiment, the second radio system comprises a complementary wireless system.

In an embodiment, the complementary wireless system comprises at least one of a wireless local area network, a global positioning system, and a bluetooth system.

In an embodiment, the open ended conductor is physically isolated from the ground contact.

In an embodiment, the loop element comprises a folded loop element.

In an embodiment, the open ended conductor is physically connected to a transmission line.

In an embodiment, the loop element is associated with a first radio system and the open ended conductor is associated with a second radio system, and wherein the transmission line carries a signal of the second radio system.

In an embodiment, the loop antenna further comprises at least one matching circuit for adjusting a resonance frequency or impedance of the loop antenna.

In an embodiment, the magnetic coupling comprises having the open ended conductor wrapped around the ground contact while physically isolated from the ground contact.

In an embodiment, the diameter of the open ended conductor wrapped around the ground contact is lower than a predetermined threshold to prevent the open ended conductor from acting as a radiator.

In an embodiment, the open ended conductor acts as a resonating element.

An embodiment of a loop antenna comprises a loop element having a feed contact and a ground contact; and an open ended conductor magnetically coupled around the ground contact, wherein the open ended conductor magnetically coupled around the ground contact comprises a planar structure.

In an embodiment, the planar structure is arranged into layers of a printed wiring board.

An embodiment of a mobile apparatus comprises at least one processor; at least one memory storing program instructions; and a loop antenna comprising a loop element having a feed contact and a ground contact; and an open ended conductor magnetically coupled around the ground contact.

In an embodiment, the open ended conductor magnetically coupled around the ground contact comprises a planar structure.

In an embodiment, the planar structure is arranged into layers of a printed wiring board of the mobile apparatus.

In an embodiment, the loop antenna is arranged in a lower portion of the mobile apparatus.

An embodiment of a mobile apparatus comprises at least one processor; at least one memory storing program instructions; and a loop antenna comprising a loop element having a feed contact and a ground contact; and an open ended conductor magnetically coupled around the ground contact.

An embodiment of a loop antenna comprises a loop element having a feed contact and a ground contact; and an open ended conductor magnetically coupled around the ground contact.

In an embodiment as any of those defined above, the length of the open ended conductor is substantially equal to a quarter of a wavelength at a frequency of operation.

In an embodiment as any of those defined above, the magnetic coupling comprises having the open ended conductor wrapped around the ground contact while physically isolated from the ground contact.

In an embodiment as any of those defined above, the diameter of the open ended conductor wrapped around the ground contact is lower than a predetermined threshold to prevent the open ended conductor from acting as a radiator.

In an embodiment as any of those defined above, the open ended conductor acts as a resonating element.

In an embodiment as any of those defined above, the loop element is associated with a first radio system and the open ended conductor is associated with a second radio system.

In an embodiment as any of those defined above, the first radio system comprises a cellular radio system.

In an embodiment as any of those defined above, the second radio system comprises a complementary wireless system.

In an embodiment as any of those defined above, the complementary wireless system comprises at least one of a wireless local area network, a global positioning system, and a bluetooth system.

In an embodiment as any of those defined above, the open ended conductor is physically connected to a transmission line.

In an embodiment as any of those defined above, the loop antenna further comprises at least one matching circuit for adjusting a resonance frequency or impedance of the loop antenna.

In an embodiment as any of those defined above, the open ended conductor magnetically coupled around the ground contact comprises a planar structure.

In an embodiment as any of those defined above, the planar structure is arranged into layers of a printed wiring board.

The term 'computer', 'computing-based device', 'apparatus' or 'mobile apparatus' is used herein to refer to any device with processing capability such that it can execute instructions. Those skilled in the art will realize that such processing capabilities are incorporated into many different devices and therefore the terms 'computer' and 'computing-based device' each include PCs, servers, mobile telephones (including smart phones), tablet computers, set-top boxes, media players, games consoles, personal digital assistants and many other devices.

Any range or device value given herein may be extended or altered without losing the effect sought.

Although the subject matter has been described in language specific to structural features and/or acts, it is to be understood that the subject matter defined in the appended claims is not necessarily limited to the specific features or acts described above. Rather, the specific features and acts described above are disclosed as examples of implementing the claims and other equivalent features and acts are intended to be within the scope of the claims.

It will be understood that the benefits and advantages described above may relate to one embodiment or may relate to several embodiments. The embodiments are not limited to those that solve any or all of the stated problems or those that have any or all of the stated benefits and advantages. It will further be understood that reference to 'an' item refers to one or more of those items.

Aspects of any of the examples described above may be combined with aspects of any of the other examples described to form further examples without losing the effect sought.

The term 'comprising' is used herein to mean including the elements identified, but that such elements do not comprise an exclusive list and an antenna or apparatus may contain additional elements.

It will be understood that the above description is given by way of example only and that various modifications may be made by those skilled in the art. The above specification, examples and data provide a complete description of the structure and use of exemplary embodiments. Although various embodiments have been described above with a certain degree of particularity, or with reference to one or more individual embodiments, those skilled in the art could make numerous alterations to the disclosed embodiments without departing from the spirit or scope of this specification.

The invention claimed is:

1. A loop antenna, comprising:

a loop element having a feed contact and a ground contact; and an open ended conductor wrapped around and magnetically coupled with the ground contact, the open ended conductor comprising an open end and another end that is connected to a transmission line.

2. A loop antenna as claimed in claim 1, wherein the length of the open ended conductor is substantially equal to a quarter of a wavelength at a frequency of operation.

3. A loop antenna as claimed in claim 1, wherein the loop element is associated with a first radio system and the open ended conductor is associated with a second radio system.

4. A loop antenna as claimed in claim 3, wherein the first radio system comprises a cellular radio system.

5. A loop antenna as claimed in claim 3, wherein the second radio system comprises a complementary wireless system.

6. A loop antenna as claimed in claim 5, wherein the complementary wireless system comprises at least one of a wireless local area network, a global positioning system, or a bluetooth system.

7. A loop antenna as claimed in claim 1, wherein the open ended conductor is physically isolated from the ground contact.

8. A loop antenna as claimed in claim 1, wherein the loop element comprises a folded loop element.

9. A loop antenna as claimed in claim 1, wherein the open ended conductor is physically connected to a transmission line.

10. A loop antenna as claimed in claim 9, wherein the loop element is associated with a first radio system and the open ended conductor is associated with a second radio system, and wherein the transmission line carries a signal of the second radio system.

11. A loop antenna as claimed in claim 1, further comprising at least one matching circuit for adjusting a resonance frequency or impedance of the loop antenna.

12. A loop antenna as claimed in claim 1, wherein the open ended conductor is wrapped around the ground contact while physically isolated from the ground contact.

13. A loop antenna as claimed in claim 12, wherein the diameter of the open ended conductor wrapped around the ground contact is lower than a predetermined threshold to prevent the open ended conductor from acting as a radiator.

14. A loop antenna as claimed in claim 1, wherein the open ended conductor acts as a resonating element.

15. A loop antenna, comprising:

a loop element having a feed contact and a ground contact; and an open ended conductor wrapped around and magnetically coupled with the ground contact, wherein the open ended conductor magnetically coupled around the ground contact comprises a planar structure.

16. A loop antenna as claimed in claim 15, wherein the planar structure is arranged into layers of a printed wiring board.

17. A mobile apparatus, comprising:

at least one processor;

at least one memory storing program instructions; and a loop antenna comprising:

a loop element having a feed contact and a ground contact; and an open ended conductor wrapped around and magnetically coupled with the ground contact, the open ended conductor comprising an open end and another end that is connected to a transmission line.

18. A mobile apparatus as claimed in claim 17, wherein the open ended conductor magnetically coupled around the ground contact comprises a planar structure.

19. A mobile apparatus as claimed in claim 18, wherein the planar structure is arranged into layers of a printed wiring board of the mobile apparatus.

20. A mobile apparatus as claimed in claim 17, wherein the loop antenna is arranged in a lower portion of the mobile apparatus.

* * * * *